US008261878B2

(12) United States Patent
Grome

(10) Patent No.: US 8,261,878 B2
(45) Date of Patent: Sep. 11, 2012

(54) FALL RESTRAINT SYSTEM

(75) Inventor: Michael S. Grome, Jamestown, OH (US)

(73) Assignee: Sunoco Partners Marketing & Terminals L.P., Philadelphia, PA (US)

( * ) Notice: Subject to any disclaimer, the term of this patent is extended or adjusted under 35 U.S.C. 154(b) by 351 days.

(21) Appl. No.: 12/686,935

(22) Filed: Jan. 13, 2010

(65) Prior Publication Data

US 2011/0168489 A1 Jul. 14, 2011

(51) Int. Cl.
*A62B 1/16* (2006.01)

(52) U.S. Cl. ..... 182/9

(58) Field of Classification Search ..... 182/3, 9, 182/45, 112; 52/146; 248/148
See application file for complete search history.

(56) References Cited

U.S. PATENT DOCUMENTS

| | | | | |
|---|---|---|---|---|
| 3,978,989 | A * | 9/1976 | Avila, Jr. | 212/176 |
| 4,607,724 | A * | 8/1986 | Hillberg | 182/3 |
| 4,852,692 | A * | 8/1989 | Flaherty | 340/573.1 |
| 5,143,171 | A * | 9/1992 | Glynn et al. | 182/3 |
| 5,718,305 | A * | 2/1998 | Palmer | 182/45 |
| 6,478,111 | B2 * | 11/2002 | Olson et al. | 182/3 |
| 6,695,095 | B1 * | 2/2004 | Franke | 182/3 |
| 6,715,238 | B2 * | 4/2004 | Zambelli et al. | 52/24 |
| 6,779,630 | B2 * | 8/2004 | Choate | 182/36 |
| 6,786,020 | B2 * | 9/2004 | Poldmaa | 52/704 |
| 7,537,085 | B2 * | 5/2009 | Vetesnik | 182/3 |
| 8,025,125 | B2 * | 9/2011 | Vetesnik et al. | 182/45 |
| 2001/0027897 | A1 * | 10/2001 | Olson et al. | 182/45 |
| 2001/0032435 | A1 * | 10/2001 | Austin | 52/749.12 |
| 2002/0017427 | A1 | 2/2002 | Guenette et al. | |
| 2005/0098381 | A1 * | 5/2005 | Flaherty | 182/3 |
| 2005/0269154 | A1 * | 12/2005 | Siemienowicz | 182/3 |
| 2006/0032703 | A1 | 2/2006 | Burdet | |
| 2006/0289233 | A1 * | 12/2006 | Flaherty | 182/45 |
| 2010/0243837 | A1 * | 9/2010 | Cox | 248/237 |
| 2012/0037451 | A1 * | 2/2012 | Payne et al. | 182/112 |

FOREIGN PATENT DOCUMENTS

EP 1699991 B1 12/2007

OTHER PUBLICATIONS

Patel, "A New E-Paper Competitor", Technology Review, Apr. 27, 2009, MIT, http://www.technologyreview.com.

* cited by examiner

*Primary Examiner* — Darnell Jayne
*Assistant Examiner* — Kristine Florio
(74) *Attorney, Agent, or Firm* — Fox Rothschild LLP

(57) ABSTRACT

A fall restraint system includes a central support positioned over an apex of a container structure such as a domed roof storage tank. Cable receiving members are connected to the central support. Outer support members are secured to a side of the container structure. A structural support cable is connected to each of the outer support members. Each structural support cable is also connected to the central support. A tie-off structure including a cable and a harness is connected to the central support so that the harness may move around the central support. The system also may include support brackets that secure the outer support members to the side of the container structure. Each such support bracket may include a receptacle to receive one of the outer support members. The system is removably attached to the container structure, without any welding.

15 Claims, 6 Drawing Sheets

FALL RESTRAINT SYSTEM

BACKGROUND

The disclosed embodiments generally relate to a fall restraint system, and in particular a fall restraint system that can be installed on the roof of an elevated structure at a bulk storage facility, such as a dome-shaped fuel storage tank.

Fuel storage facilities, commonly known as tank farms, contain large, cylindrical tanks of oil, gasoline, or other fuel products. Tanks containing volatile organic liquids such as gasoline often have roofs that are shaped as a geodesic dome. Such a shape provides strength to help the roof contain pressures that can build inside the tank as the volatile compound vaporizes.

When a dome-shaped roof on a liquid storage tank requires inspection or repair, a worker must climb onto the roof to perform the inspection or work. Because of the sloped shape of the roof, it is desirable to protect workers using a fall restraint system. However, many existing tanks are not equipped with such a system. In order to install and fasten a fall restraint system, the tank must be drained of liquid so that any welding equipment used to fasten the restraint's anchors to the tank does not create a risk of explosion. This is a labor-intensive and time consuming process, and it also requires the tank to be unavailable for storage operations while the work is performed.

Accordingly, the inventor has developed an improved fall restraint system that can be used with existing roofed structures, such as volatile organic liquid storage tanks having dome-shaped roofs.

SUMMARY

In an embodiment, a storage tank fall restraint system has a central support that includes a base and a post. The base has a circular rim and a concave wall extending inward from the rim to define a cavity within the base to fit over an apex of a roof of a storage tank. The post is secured to the base and extends from the base. A set of cable receiving members arranged around the post, each of which receives a first connector of a structural support cable. Another connector of each structural support cable is secured to a support post that is positioned on the side of the tank. Support brackets, each of which includes a pole receiver and a securing structure, secure each support post to the side of the tank without welding. Each support pole includes a joint that secures the support pole one of the pole receivers. A tie-off structure including at least one human supporting cable receiver is rotatably connected to the post so that the human supporting cable receiver may rotate with respect to the post and the base. A human supporting cable is secured to the human supporting cable receiver at a first end and to a safety harness at a second end.

In some embodiments, the tie-off structure may be positioned at or near an end of central support member that is opposite the base, the support brackets may be positioned around the central support member at a location that is between the tie-off structure and the base, and the cable receiving members may be positioned around the central support member at a location that is between the tie-off structure and the support brackets. Optionally, each structural support cable may include a turnbuckle. Each support pole member may include two or more longitudinal members, each of which has a male portion or a female portion so that adjacent longitudinal members are connected together. A set of legs may be provided around the post, each of which includes a foot structure that secures the leg to the roof of the tank.

The central support member may include an outer sleeve and an inner post so that the inner sleeve may be extended from or retracted within the outer sleeve to adjust the length of the central support member. If so, the outer sleeve may be cylindrical and have a threaded interior wall so that it receives a cylindrical inner structure (which has a threaded outer wall) so that the threaded exterior wall of the inner structure conforms to the threaded interior wall of the sleeve in a screw-like fashion.

In an alternate embodiment, a fall restraint system for a container structure having a domed roof includes a base having a circular rim and a concave wall extending inward from the rim to define a cavity within the base. A central support member extends upward from the base. A tie-off structure having at least one first cable receiving structure is rotatably connected to the central support member so that each of the first cable receiving structures may rotate 360° with respect to the central support member and the base. Several second cable receiving structures are arranged around and connected to the central support member. Several outer support members, each having a third support cable receiving structure, are arranged around a wall of the container structure. A cable runs from each of the second cable receiving structures to a corresponding third cable receiving structure. Each of these cables may include a turnbuckle that connect that cable's corresponding first attachment structure to the first end of that cable.

In an alternate embodiment, a fall restraint system includes a central support member having a base that is positioned over a roof of a container structure. Two or more legs are positioned around the base to contact the roof. Two or more cable receiving members are connected to the central support member. Two or more outer support members are secured to a side of the container structure. A structural support cable is connected to each of the outer support members. Each structural support cable is also connected to the central support member. A tie-off structure including a cable and a harness is connected to the central support member so that the harness may move around the central support member. The system also may include support brackets that secure the outer support members to the side of the container structure. Each such support bracket may include a receptacle to receive one of the outer support members, and a connector to secure the bracket to the side of the container structure.

BRIEF DESCRIPTION OF THE DRAWINGS

Aspects, features, benefits and advantages of the embodiments described in this document will be apparent with regard to the following description, appended claims, and accompanying drawings where:

DETAILED DESCRIPTION

Before the present methods and systems are described, it is to be understood that this invention is not limited to the particular systems, methodologies or protocols described, as these may vary. The terminology used in this document is for the purpose of describing particular embodiments only, and it is not intended to limit the scope of the present disclosure.

As used in this document and in the appended claims, the singular forms "a," "an," and "the" include the plural reference unless the context clearly dictates otherwise. The term "comprising" means "including, but not limited to." Unless defined otherwise, all technical and scientific terms used herein have the same meanings as commonly understood by one of ordinary skill in the art.

Figure 1:
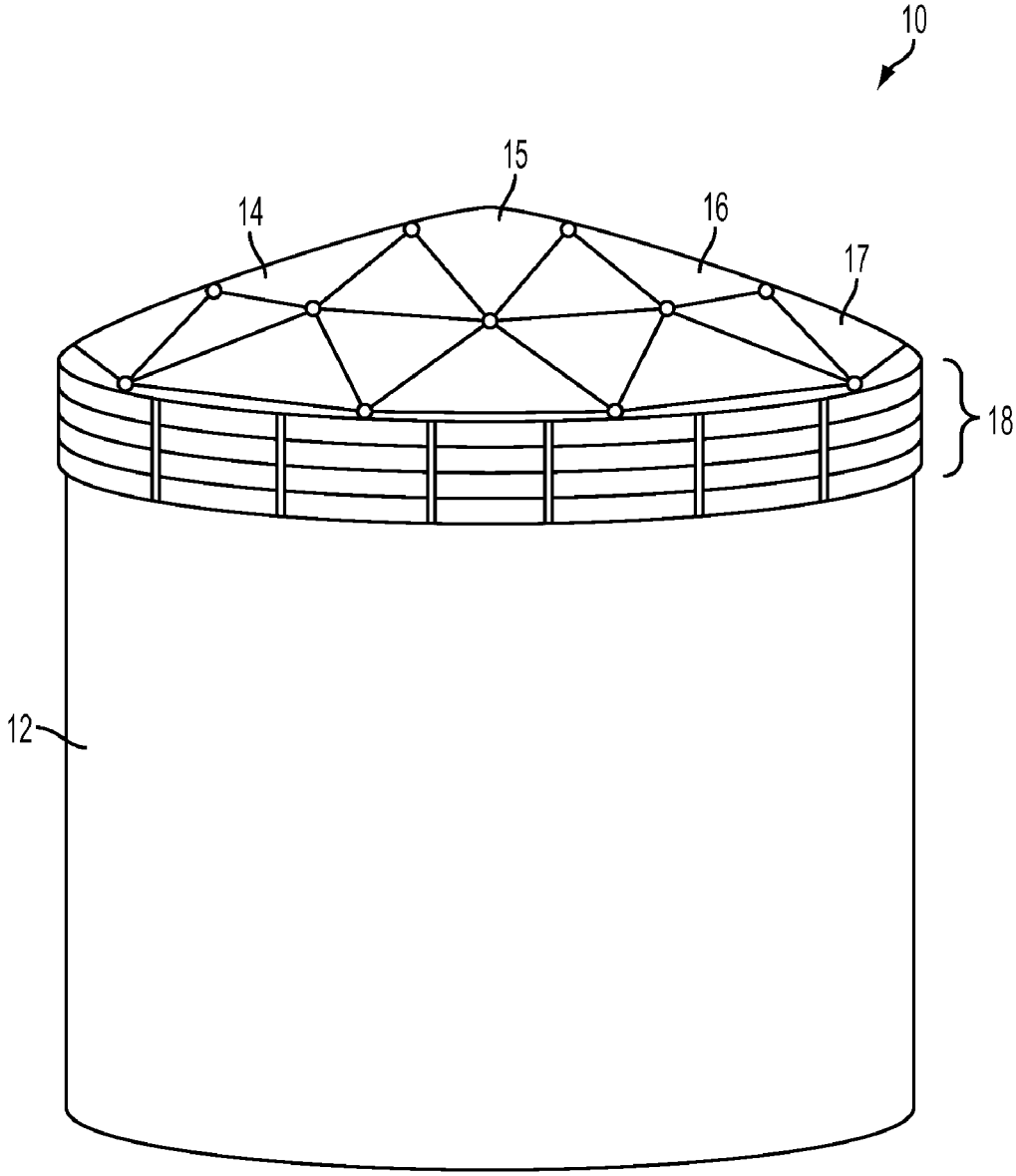
FIG. 1 (PRIOR ART)
FIG. 1 illustrates a liquid storage structure having a dome-shaped roof, such as may be found in the prior art.

FIG. 1 illustrates a storage tank 10 of the type that may be used to hold gasoline, jet fuel, diesel fuel, ethanol, other petroleum products, oil, compressed gas or another volatile organic compound, or a liquid such as water or other material. The tank may include a vessel 12 that holds the gas or liquid and a roof 14 that covers the vessel. The roof 14 may be dome-shaped as shown, or it may be conical or of another shape having an apex 16. If the roof is dome-shaped, it may be formed of triangular panels 16 and struts 17 to which the panels are joined. A wind ring 18 may surround the top portion of the walls of the vessel 12 at a location near or adjacent to the roof 14.

Figure 2:
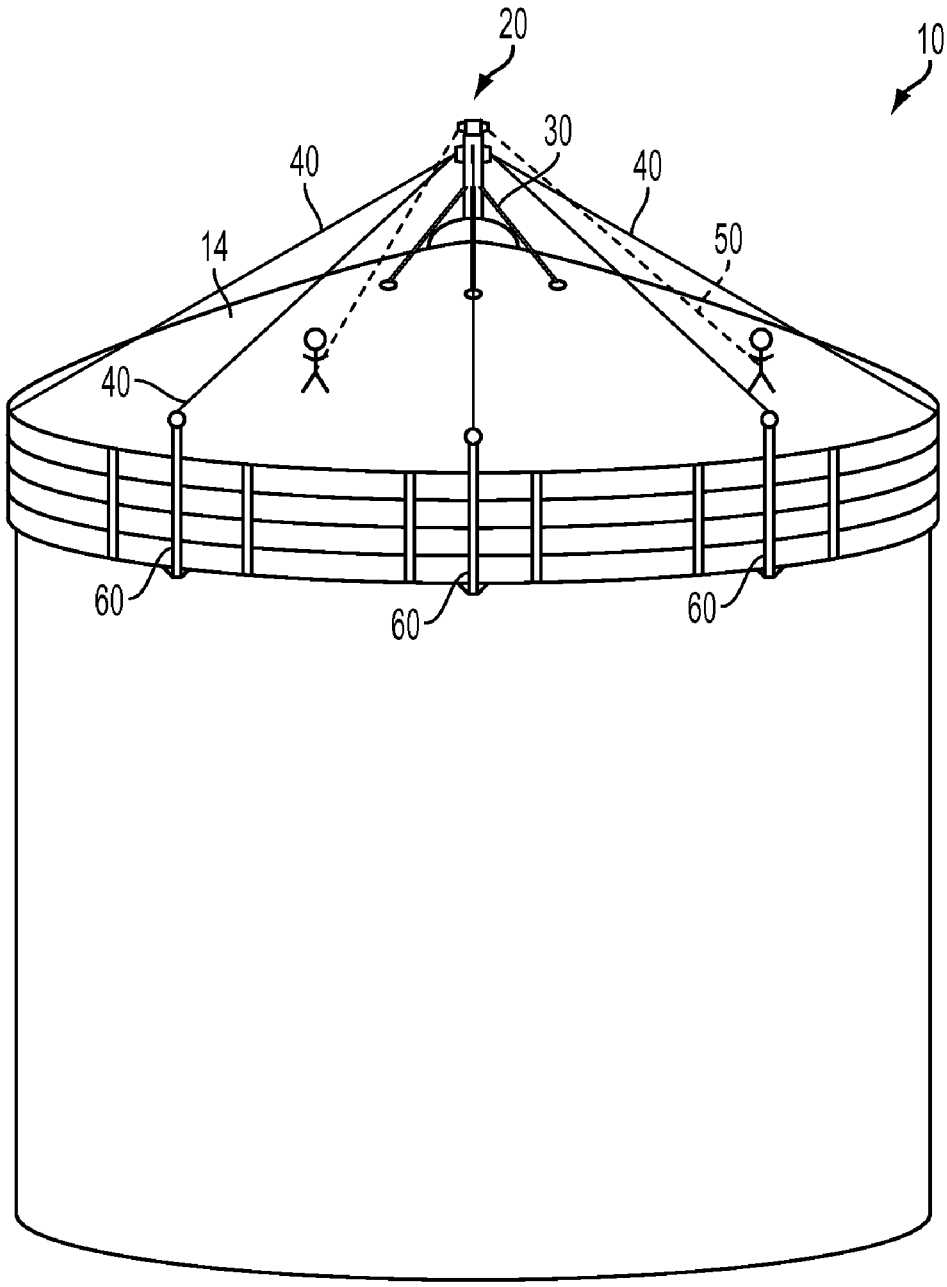
FIG. 2 illustrates a liquid storage structure having an installed fall restraint system.

FIG. 2 illustrates the tank 10 with the geodesic features of the dome 14 omitted from the drawing for clarity so that a fall restraint system may be illustrated. As shown, the fall restraint system may include a central support structure 20 to which a set of support legs 30, a set of structural support cables 40, and one or more human support cables 50 are connected. As shown, each structural support cable 40 is connected to the central support structure 20 at a first end and to an outer support member 60 at a second end. The outer support members are arranged around walls of the tank, preferably on or near the wind ring 18, so that the outer support members 60 may be attached to the tank without the need to either weld the support member to the tank or puncture the tank wall.

FIG. 2 also shows that one or more human support cables 50 may be secured to the central support member 20 at one end. Each human support cable 50 also may include or be attached to a safety harness or other structure that connects the cable to a human so that the human is tethered to the central support and will not fall off of the tank. Each human support cable 50 will have a length that is no longer than the distance from the apex of the domed roof 14 to the outer edge of the domed roof.

Figure 3:
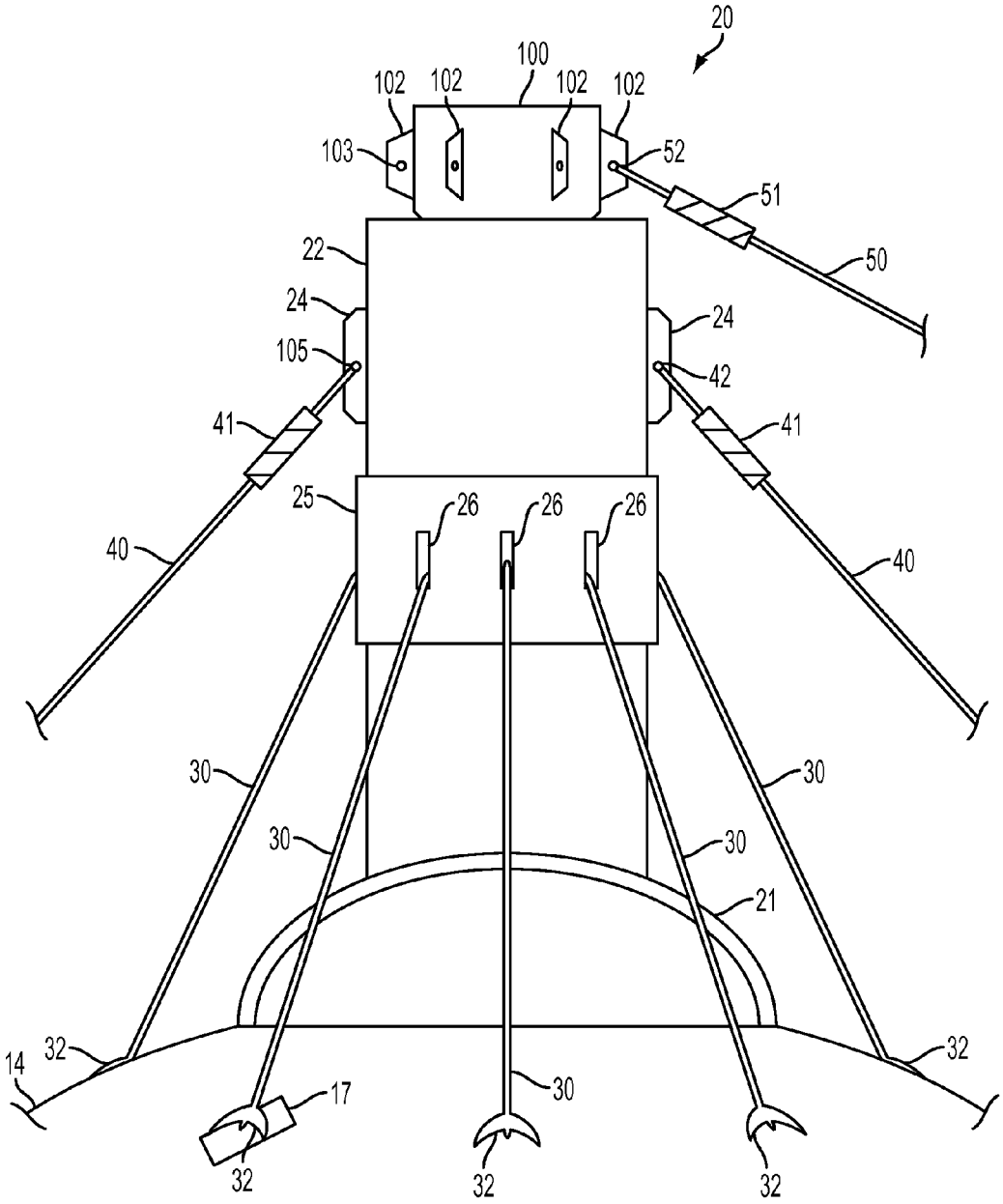
FIG. 3 illustrates a central support structure, with support legs and various cables extending from the central support structure.

FIG. 3 illustrates exemplary elements of a central support structure 20. As shown in FIG. 3, the central support structure 20 includes a base 21 and a post 22 or similar central support member. The base fits over an apex of the roof 14 of the storage tank and may rest on the roof without being permanently attached. The post 22 is a rigid structure that extends upward from the base. The base and post may be made of steel or another durable, rigid material.

At or near the top of the post is a tie-off structure 100 that includes a one or more cable supports 102 arranged around the tie-off structure. Each cable support 102, also referred to in the document as a cable receiving structure, includes a receptacle, hole, hook, gripping member, or other structure 103 that receives and secures a human supporting cable 50 to the tie-off structure. The human supporting cable may include an eyelet, knot, hook or other member 52 that secures the cable 50 to the receiving structure 103. The cable 50 also may include a turnbuckle 51 positioned somewhere between the securing member 52 and the harness that secures a human to the cable. The tie-off structure 100 is rotatable, preferably allowing for full 360° rotation so that a human who is attached via the cable 50 may move freely about the roof 14.

The central support structure 20 also includes a set of cable receiving members 24 arranged around the post 22, preferably spaced approximately equal distances apart around the post. Each cable receiving member 24 includes a receptacle, hole, hook, gripping member, or other structure 105 that receives and secures a structural support cable 40 to the post 22. Each structural support cable 40 may include an eyelet, knot, hook or other member 42 that secures the cable 40 to the receiving structure 105. Each structural support cable 40 also may include a turnbuckle 41 positioned somewhere between the securing or receiving member 24 and the end of the cable that is secured to the outer support members (see element 60 in FIG. 1). Optionally, the cable receiving members 24 may be provided on a bracket, collar or other structure that allows the cable receiving members to be adjusted or rotated around the post 22.

The central support structure also includes several post support brackets 26 preferably spaced approximately equal distances apart around the post. Each post support bracket 26 includes a receptacle, hole, hook, gripping member, or other structure that receives and secures a support leg 30 to the post. Optionally, the post support brackets 26 may be provided on a collar 25 or other structure that allows the post support brackets 26 to be adjusted or rotated around or along the post 22.

As shown in FIG. 3, in various embodiments the tie-off structure 100 may be located at or near the top of the post 22. The cable receiving members 24 may be positioned under the tie-off structure 100 so that they are between the tie-off structure 100 and the base 21. The post support brackets 26 may be positioned under the cable receiving members 24 so that the post support brackets 26 are located between the cable receiving members 24 and the base 21.

Each support leg 30 is preferably made of steel, aluminum, or another rigid or semi-rigid material to provide support and stability for the central support structure 20. Optionally, the support legs 30 may include joints that permit them to be bent, or they may include a telescoping structure that allows the lengths of the poles to be adjusted. If so, each joint or telescoping structure will include a locking structure that prevents movement of the joint when the support leg is in its operable position. Each support leg 30 also includes a foot member 32 which may be connected to the roof 14. The connection may be by friction, as in a case where the foot member 32 is covered with a rubber or other slip-resistant material. Alternatively, the connection may be by a mechanical connector such as bolt, hook, or other attachment member that secures the foot member to a hole, fin 19, or other structure on the roof. In some embodiments, both a friction mount and a mechanical connection may be provided.

Figure 4:
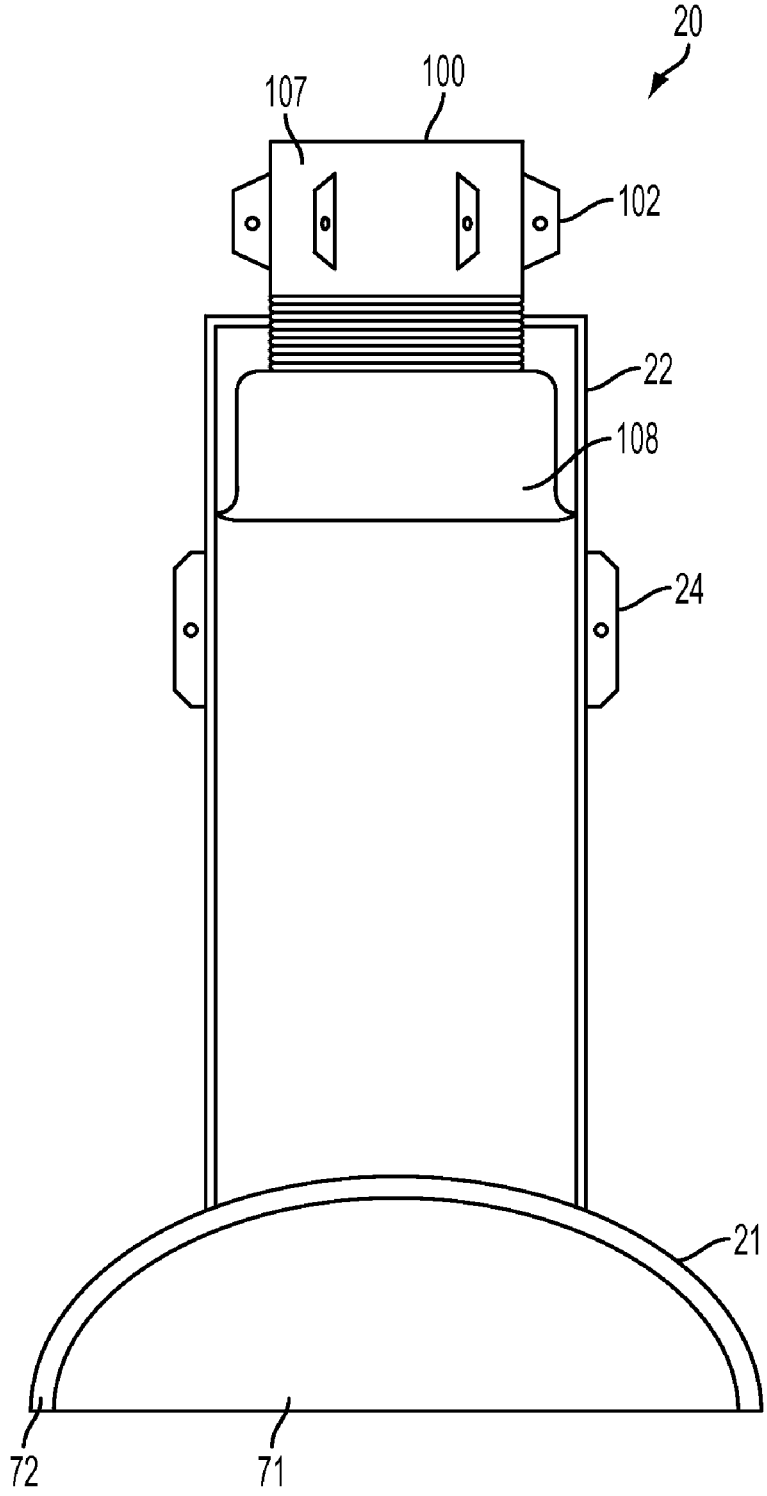
FIG. 4 illustrates a cross-section of a central support structure.

FIG. 4 illustrates a cross-section of the central support structure 20 in which the post 22 and base 21 are shown in shown as a cut-away view so that additional elements of an exemplary tie-off structure 100 and base 21 may be shown. As shown in FIG. 4, the base 21 may include a rim 72 and a concave wall 71 that extends away from the rim and inward to define a cavity within the base. Thus, the base 21 may be essentially bowl-shaped so that an apex of the a storage container's roof may be surrounded by the cavity. Optionally, the rim 72 may be covered by a friction-resistant material such as rubber. The tie-off structure 100 includes an exterior portion 107 that includes the cable supports 102 and an interior section 108 that serves to secure the tie-off structure within the post 22. A threaded member 109, post-and-bearing, or another rotatable structure connects the exterior portion 107 and the interior section 108 to allow the tie-off structure to rotate with respect to the post 22.

Figure 5:
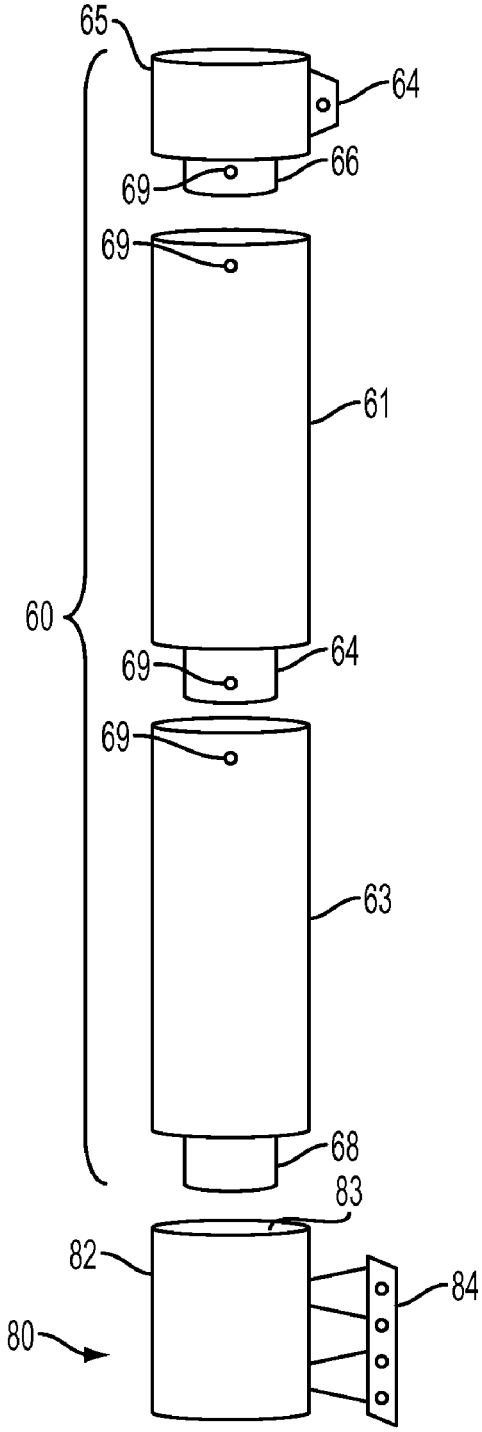
FIG. 5 illustrates an exemplary outer support member and support bracket.

FIG. 5 illustrates an exemplary support member 60 to which the support cables may be secured. In some embodiments, the support member may be a single longitudinal member having a cable receiving member to which the support cable may be secured. In other embodiments, such as the embodiment shown in FIG. 5, the support member 60 may be made up of two or more members so that the length of the support member may be adjusted to fit various tanks. For example, FIG. 5 shows an expanded view of a support member made of a first longitudinal member 61, a second longitudinal member 63 and a cap member 65. Each member includes a pin 64, 66, 68 or similar structure that is narrower than its adjoining member so that the pin can fit into the adjoining member. The members may have varying lengths so that they can be interchanged as needed to fit the particular installation. Alternatively, the pin may extend upward, or the longitudinal members may simply have a flared end so that adjoining members may be inserted into each other. Optionally, the members and pins may include holes 69 through which a bolt, pin, or other securing structure may be placed to prevent movement of the various members once the overall member 60 is assembled. The uppermost longitudinal member 65 may be a cap, and/or it may include a receptacle, hole, hook, gripping member, or other structure 64 that receives and secures a structural support cable to the member 60.

The lowermost longitudinal member 63 has a pin 68 or similar member that fits into a pole receiver 82 of a support bracket 80. Although FIG. 5 shows the pole receiver 82 as a receptacle 83 (female) and the support member as having a pin 68, these structures may be reversed, or other structures may be used that allow the member 60 to securely attach to the pole receiver 82.

Figure 6:
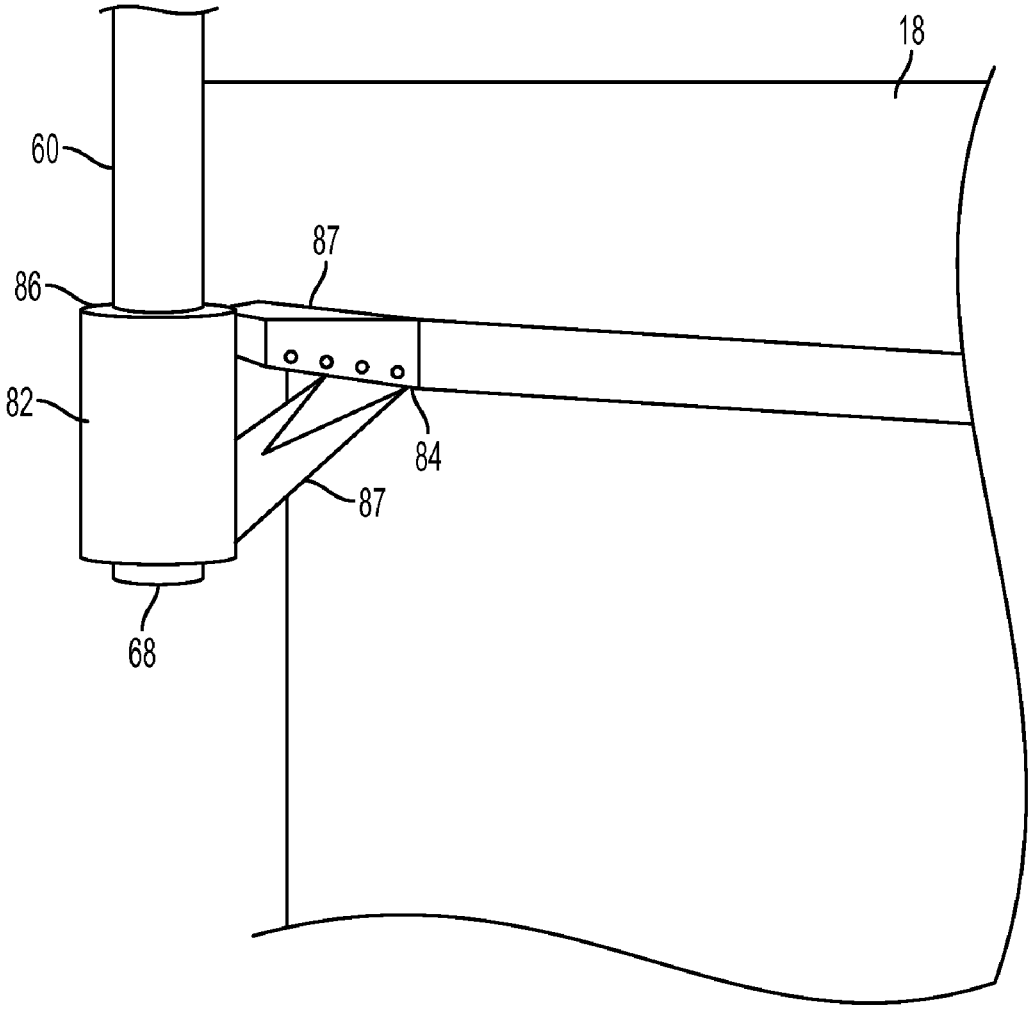
FIG. 6 illustrates an exemplary outer support member and support bracket attached to the side of a storage tank.

The support bracket 80 also includes a connection bracket 84 to attach the support bracket to a side of the storage container. As shown in FIG. 5, the connection bracket 84 may include holes through which pins, bolts, or other securing structures may be placed. FIG. 6 shows how the connection bracket 84 may be secured to the wind ring 18 or another side portion of the storage container. The pole receiver 82 is attached to the connecting member 84 by one or more braces 87. The pole receiver receives the support member 60. Optionally, a portion of the support member (such as the lowermost pin) may extend fully or beyond the pole receiver 82. A slip joint 86 or other structure may further help to secure the support member 60 to the pole receiver 82.

With such a structure, the fall restraint system may be installed on an existing tank without any requirement for welding any portion of the system to the tank. Once support brackets for the pole receiver are installed on a tank, such as by bolting the support brackets to the wind ring or another structure on the side of the tank, all of the other parts of the system may be installed or removed without any drilling of holes. Optionally, holes may be drilled at one time to allow the support legs that extend from the central support member to be attached to fins or other structures on the roof.

The disclosure contained in this document is not intended to be limiting. The above-disclosed and other features and functions, or alternatives thereof, may be desirably combined into many other different systems or applications. Various presently unforeseen or unanticipated alternatives, modifications, variations or improvements therein may be subsequently made by those skilled in the art and are also intended to be encompassed by the following claims.

What is claimed is:

1. A storage tank fall restraint system, comprising:

a central support comprising:

a base that comprises a circular rim and a concave wall extending inward from the rim to define a cavity within the base to fit over an apex of a roof of a storage tank;

a post secured to the base and extending vertically from the base and having a vertical axis;

a plurality of cable receiving members arranged around the post; and a tie-off structure comprising a human supporting cable receiver, the tie-off structure being rotatably connected to the post about the vertical axis so that the human supporting cable receiver may rotate with respect to the post and the base;

a plurality of outer support members, each outer support member comprising:

a support bracket including a pole receiver and a securing structure that secures the bracket to a side of the tank without welding;

support pole including a joint that secures the support pole to the pole receiver;

a plurality of structural support cables, each structural support cable including a first connector that secures the structural support cable to the post via one of the cable receiving members and a second connector that secures the cable to one of the support poles; and a human supporting cable that is secured to the human supporting cable receiver at a first end and to a safety harness at a second end.

2. The system of claim 1, further comprising a plurality of turnbuckles, wherein each turnbuckle is attached to one of the structural support cables.

3. The system of claim 1, wherein:

the tie-off structure is positioned at or near an end of the central support that is opposite the base;

the central support further comprises a plurality of post support brackets positioned around the post at a location that is between the tie-off structure and the base; and the cable receiving members are positioned around the central support at a location that is between the tie-off structure and the post support brackets.

4. The system of claim 1 wherein each support pole member comprises a plurality of longitudinal members, each of which has a male portion or a female portion so that adjacent longitudinal members are mated.

5. The system of claim 1 wherein the central support member comprises an outer sleeve and an inner post so that the inner sleeve may be extended from or retracted within the outer sleeve to adjust the length of the central support member.

6. The system of claim 5, wherein:

the outer sleeve is cylindrical and comprises a threaded interior wall; and the inner structure is cylindrical and comprises a threaded exterior wall so that the threaded exterior wall of the inner structure conforms to the threaded interior wall of the sleeve in a screw-like fashion.

7. The system of claim 1, further comprising a plurality of legs attached to the post, each leg having a foot structure that connects the leg to an element on the roof of the tank.

8. A fall restraint system for a container structure having a domed roof, comprising:

a base having a rim and a concave wall extending inward from the rim to define a cavity within the base;

a central support member upwardly extending from the base having a vertical axis;

a tie-off structure having at least one first cable receiving structure, the tie-off structure rotatably connected to the central support member about the vertical axis so that each of the first cable receiving structures may rotate 360 degrees with respect to the central support member and the base;

a plurality of second cable receiving structures arranged around and connected to the central support member;

a plurality of outer support members, each having a third support cable receiving structure;

a first set of cables, each cable in the first set having a first attachment structure that is adapted to be secured to one of the second cable receiving structures, and each cable in the first set also having a second attachment structure that is adapted to be secured to one of the third cable receiving structures.

9. The system of claim 8, further comprising a plurality of turnbuckles, wherein each turnbuckle is attached to one of the cables in the first set to connect that cable's corresponding first attachment structure to the first end of that cable.

10. The system of claim 8, wherein:

the central support member has a first end and a second end, the first end is connected to the base;

the tie-off structure is positioned to surround the central support member at or near the second end; and the second cable receiving structures are positioned along the central support member between the tie-off bracket and the base.

11. The system of claim 8 wherein each outer support member comprises an outer sleeve and an inner post so that the inner sleeve may be extended from or retracted within the outer sleeve to adjust the length of the outer support member.

12. The system of claim 8 wherein the central support member comprises an outer sleeve and an inner post so that the inner sleeve may be extended from or retracted within the outer sleeve to adjust the length of the central support member.

13. The system of claim 12, wherein:

the outer sleeve is cylindrical and comprises a threaded interior wall; and the inner structure is cylindrical and comprises a threaded exterior wall so that the threaded exterior wall of the inner structure conforms to the threaded interior wall of the sleeve in a screw-like fashion.

14. The system of claim 8, further comprising:

a plurality of support legs arranged around the central support member to flare away and down from the central support member, each support leg comprising:

a first end with a first attachment structure that is adapted to connect with the central support member in a location between the second support members and the base, and a second end having a mountable structure to connect the support leg to a roof of a container structure without welding.

15. The system of claim 8, further comprising a plurality of support brackets, each support bracket comprising:

a receptacle to receive and secure one of the outer support members; and a connector to secure the bracket to a side of a domed roof container structure without welding.

* * * * *